US006000944A

United States Patent [19]

Schiefer

[11] Patent Number: 6,000,944

[45] Date of Patent: Dec. 14, 1999

[54] SPORT TRAINING AND EXERCISE SYSTEM

[76] Inventor: Thomas P. Schiefer, 4209 W. Surrey, Phoenix, Ariz. 85029

[21] Appl. No.: 09/169,469

[22] Filed: Oct. 9, 1998

[51] Int. Cl.[6] ..... A63B 69/24

[52] U.S. Cl. ..... 434/251; 473/430

[58] Field of Search ..... 434/247, 251, 434/258, 248; 473/422, 423, 429, 430, 446, 438; 482/83, 86, 87

[56] References Cited

U.S. PATENT DOCUMENTS

| | | | |
|---|---|---|---|
| 1,655,599 | 1/1928 | Dolan, Jr. | 473/422 |
| 3,804,409 | 4/1974 | Schachner | 473/422 X |
| 3,924,855 | 12/1975 | Pretorius | 473/429 |
| 4,674,744 | 6/1987 | Walsh | 473/422 |
| 5,386,989 | 2/1995 | Broadway | 473/429 |
| 5,688,195 | 11/1997 | Caso | 473/429 |
| 5,823,895 | 10/1998 | Rasic | 473/430 |

*Primary Examiner*—Kien T. Nguyen
*Attorney, Agent, or Firm*—Meschkow & Gresham, P.L.C.; Jordan M. Meschkow; Lowell W. Gresham

[57] ABSTRACT

A sport training and exercise system (20) is provided. System (20) has a pair of base members (24), a pair of upright members (26) coupled to the pair of base members (24), and a transverse member (28) coupled to the pair of upright members (26). System (20) may have a tether-attachment device (46) coupled to one of the pair of upright members (26) at a tether-attachment-device location (52), and a tether (38) tethering a singly-tethered ball (22) to the tether-attachment device (46). Alternatively, system (20) may have a pair of tether-attachment devices (46) coupled to the pair of upright members (26) at a pair of tether-attachment-device locations (52), and a pair of tethers (38) tethering a doubly-tethered ball (80) to the pair of tether-attachment devices (46). System (20) is also configurable as a soccer goal (90) or a football goal (110).

17 Claims, 8 Drawing Sheets

SPORT TRAINING AND EXERCISE SYSTEM

TECHNICAL FIELD OF THE INVENTION

The present invention relates to the field of sport training and exercise systems. More specifically, the present invention relates to the field of sport training and exercise systems incorporating a tethered ball.

BACKGROUND OF THE INVENTION

In order to excel in a given sport, an athlete typically undergoes extensive training peculiar to that sport. This is especially true of field football games. Typical of such games are soccer (the U.S. common name for Association Football, called "football" outside the U.S.), Rugby football, Australian Rules Football, and football (called "American football" outside the U.S.). The common U.S. names given above will be used hereinafter.

For example, in the game of soccer a player must learn to properly control the ball with all parts of the body except the arms and hands, and including the hands if the player is a goalkeeper. This requires extensive training and practice. Such training often contains many repetitive exercises.

A problem exists with solo training in that certain desirous exercises may be difficult to achieve without an assistant to hold, throw, catch, fetch, or otherwise manipulate the ball for the athlete undergoing training. This is an inefficient utilization of resources for many repetitive exercises.

A problem also exists in that specific exercises often utilizes considerable space. This is especially true of kicking, butting, hitting, or otherwise propelling the ball.

A related problem exists in that a kicked, butted, hit, or otherwise propelled ball needs be fetched. The time taken to fetch the ball, by either the athlete or an assistant, is time not spent in training. Hence, the efficacy of the training is reduced.

A potential solution to the above and other problems is the use of specialized or customized training equipment. A problem exists with the use of such equipment, however, in that the equipment itself requires space. Once allocated, that space is thenceforth dedicated to the specific exercises for which the equipment is designed. Unless a sufficient number of athletes are to utilize the equipment, this represents an inefficient use of resources.

A related problem may lie with the availability of the space required for the specialized or customized equipment. An individual or small group, e.g., a neighborhood soccer club, may not have the resources to obtain dedicated space. They may, for example, utilize common property, such as a park, for training. Under such conditions, the individual or group may be unable to install specialized or customized equipment even were such equipment to be obtained.

Another problem with specialized or customized training equipment is that of cost. For an individual or a small group, equipment cost may be a significant factor in a small training budget. Dedicating funds to any but the most utilitarian of equipment may thus be contraindicated.

What is needed, therefore, is a sport training system that may be used by a solo athlete, not requiring the services of an assistant, is both portable, not requiring permanent installation, and easily set up and taken down, utilizes a minimum of space, serves a variety of different training and exercise functions, utilizes an exercise ball in a plurality of positions, returning that ball to the pre-established position automatically and efficiently, and is cost-efficient.

SUMMARY OF THE INVENTION

Accordingly, it is an advantage of the present invention that a sport training system for use by a solo athlete is provided.

It is another advantage of the present invention that a portable sport training and exercise system is provided.

It is another advantage of the present invention that a sport training system that may be easily set up and taken down is provided.

It is another advantage of the present invention that a sport training system utilizing a minimum of space is provided.

It is another advantage of the present invention that a sport training system serving a variety of different training and exercise functions is provided.

It is another advantage of the present invention that a sport training system utilizing an exercise ball in a plurality of positions is provided.

It is another advantage of the present invention that a sport training system automatically and efficiently returning an exercise ball to a pre-established position is provided.

It is another advantage of the present invention that a cost-efficient sport training system is provided.

The above and other advantages of the present invention are realized in one form by a sport training and exercise system having a pair of base members, a pair of upright members coupled to the base members, a transverse member coupled to the upright members, a tether-attachment device coupled to one of the upright members, a ball, and a tether tethering the ball to the tether-attachment device.

The above and other advantages of the present invention are realized in another form by a sport training and exercise system having a pair of base members, a pair of upright members coupled to the base members, a transverse member coupled to the upright members, a pair of tether-attachment devices coupled to the upright members, a ball, and a pair of tethers tethering the ball, at a pair of tether-attachment locations at a surface of the ball, to the tether-attachment devices.

The above and other advantages of the present invention are realized in yet another form by a sport training and exercise system having first base members, second base members coupled to the first base members, first upright members coupled to the first base members, a first transverse member coupled between the first upright members, second upright members coupled to the second base members, a second transverse member coupled between the second upright members, and side members coupled between the first and second upright members.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
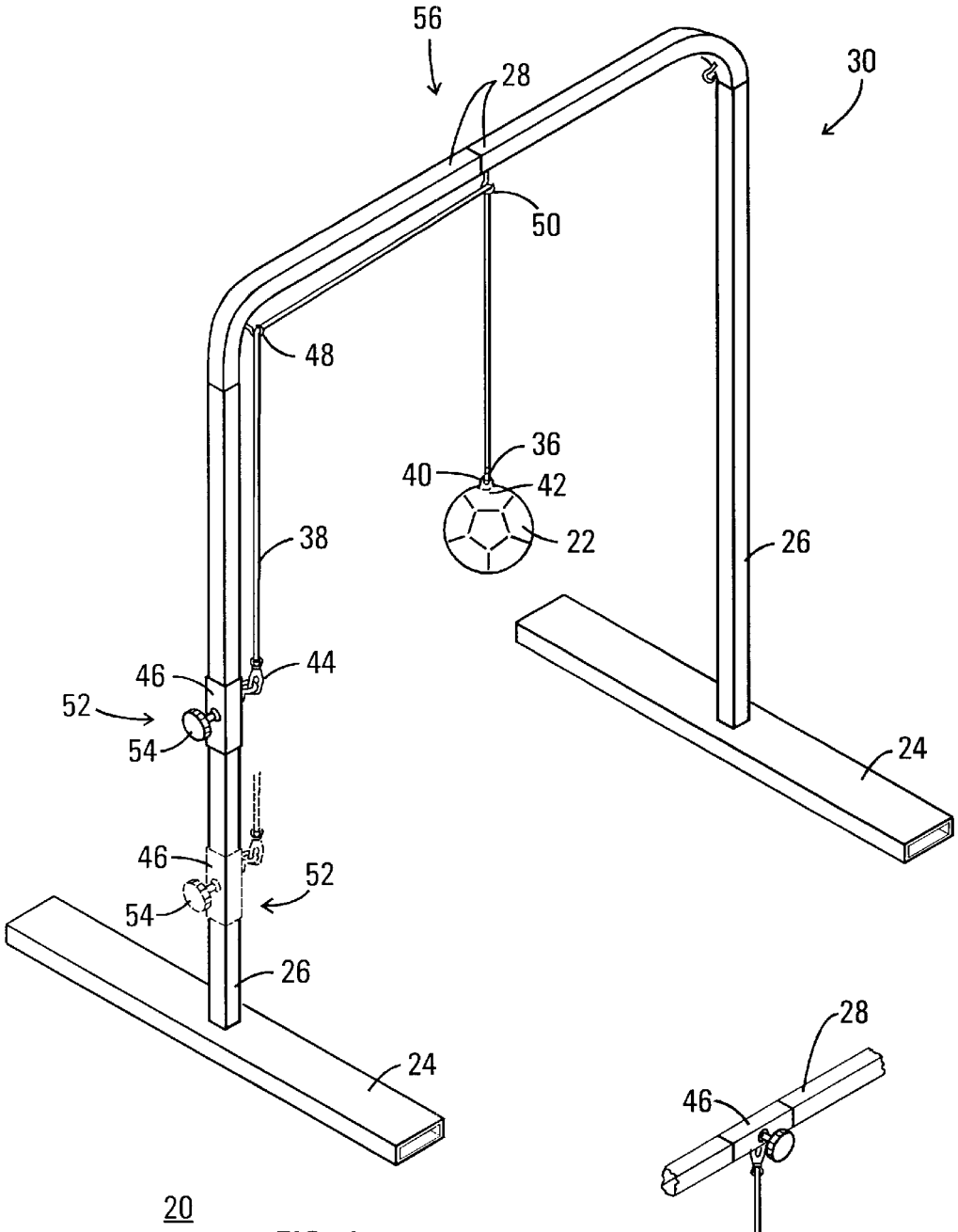
FIG. 1 depicts a sport training and exercise system configured for use with a singly-tethered ball in accordance with a preferred embodiment of the present invention.
Figure 2:
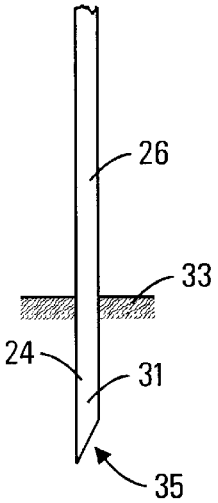
FIG. 2 depicts a base member as a portion of an upright member of the sport training and exercise system of FIG. 1 in accordance with a preferred embodiment of the present invention.

In accordance with preferred embodiments of the present invention, FIG. 1 depicts a sport training and exercise system 20 configured for use with a singly-tethered ball 22, and FIG. 2 depicts a base member 24 as a portion of an upright member 26 in sport training and exercise system 20. The following discussion refers to FIGS. 1 and 2.

In a first preferred embodiment of sport training and exercise system 20, as depicted in FIG. 1, system 20 contains a pair of base members 24, a pair of upright members 26 coupled to base members 24, and a transverse member 28 coupled between and joining upright members 26. Upright members 26 and transverse member 28 constitute a frame 30. The function of base members 24 is to provide a stable base for frame 30 and support upright members 26 in a substantially vertical position. As depicted, base members 24 are steel or aluminum tubes of rectangular cross section of sufficient size and mass to provide the desired stable base for frame 30. Base members 24 would normally lie upon the ground, i.e., a plane (not shown) passing through base members 24 would normally lie in a horizontal attitude proximate the surface of the ground, and a plane (not shown) through frame 30 would be substantially perpendicular to the surface of the ground.

Alternatively, as depicted in FIG. 2, base members 24 are the lower portions 31 of upright members 26. In such a case, lower portions 31 would be embedded into ground 33 so as to support upright members 28 in a substantially vertical attitude, i.e., a plane (not shown) through frame 30 (FIG. 1) would be substantially perpendicular to the surface of ground 31. To facilitate embedment, lower portions 31 may be equipped with pointed ends 35.

Those skilled in the art will appreciate that base members 24 may be of other configurations and materials than those depicted in FIGS. 1 and 2. For example, base members 24 may be concrete footings cast into the ground where portability and flexibility are not considerations. The realization of base members 24 in other forms does not depart from the spirit or scope of the present invention.

As stated above, frame 30 is affixed to base members 24 so that a plane (not shown) passing through frame 30 is in a substantially vertical attitude. Those skilled in the art will appreciate that any of a plurality of methods may be used to affix upright members 26 to base members 24 without departing from the spirit or scope of the present invention. Typical of such methods are welds, bolts, clamps, or pressure.

In the first preferred embodiment, upright members 26 and transverse member 28 are steel or aluminum tubes of square cross section possessing sufficient strength to provide the desired stability for the intended exercises. Those skilled in the art will appreciate that any of a plurality of materials and shapes may be used for upright members 26 and transverse member 28 without departing from the spirit or scope of the present invention.

Methods of coupling upright members 26 and transverse member 28 to form frame 30 will be discussed later.

Figure 5:
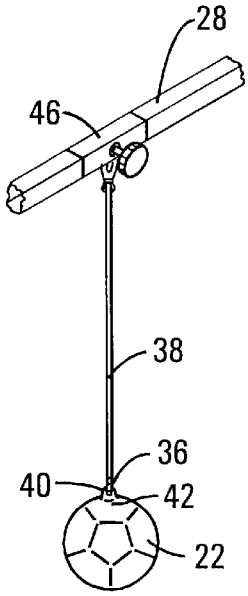
FIG. 5 depicts an alternative attachment of a singly-tethered ball to a frame of the sport training and exercise system of FIG. 1 in accordance with a preferred embodiment of the present invention.
Figure 3:
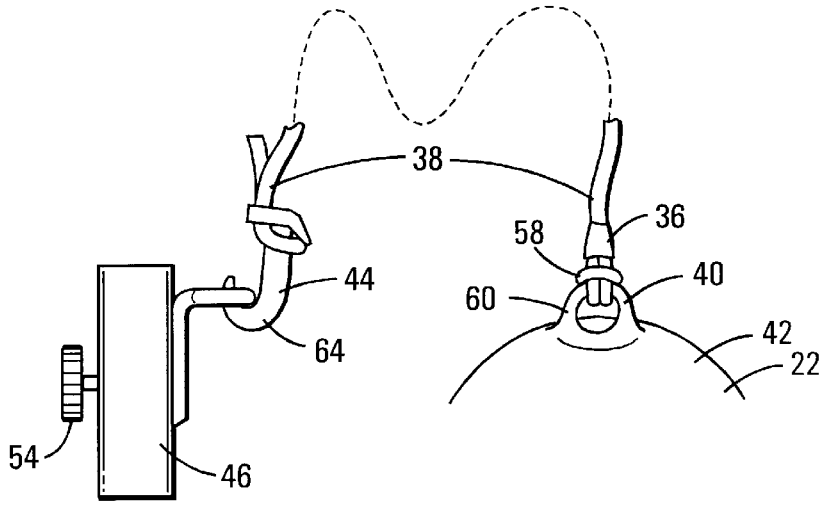
FIG. 3 depicts a fixed tether fastener fastening a tether to a tether-attachment ring at a surface of a singly-tethered ball and a disconnectable fastener fastening the tether to a tether-attachment device in accordance with a preferred embodiment of the present invention.
Figure 4:
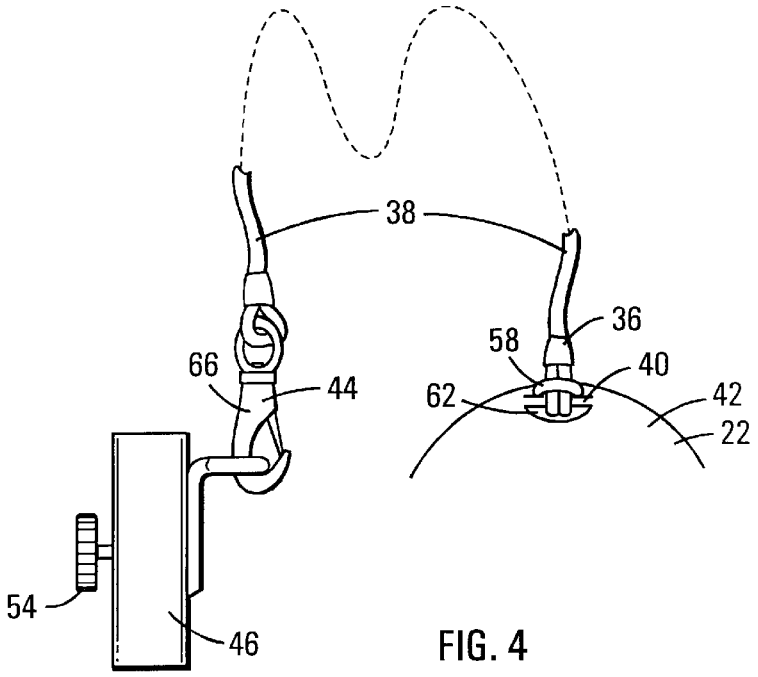
FIG. 4 depicts a fixed tether fastener fastening a tether to an alternative tether-attachment ring at a surface of a singly-tethered ball and an alternative disconnectable fastener fastening the tether to a tether-attachment device in accordance with a preferred embodiment of the present invention.

In accordance with preferred embodiments of the present invention, FIG. 3 depicts a fixed tether fastener 36 fastening a tether 38 to a tether-attachment ring 40 at a surface 42 of singly-tethered ball 22 and a disconnectable tether fastener 44 fastening tether 38 to a tether-attachment device 46, FIG. 4 depicts the same utilizing an alternative tether-attachment ring 40 and an alternative disconnectable tether fastener 44, and FIG. 5 depicts an alternative attachment of singly-tethered ball 22 to frame 30 of sport training and exercise system 20. The following discussion refers to FIGS. 1 and 3 through 5.

Frame 30 encompasses singly-tethered ball 22. Tether-attachment device 46, discussed below, is coupled to one of upright members 26. Tether 38 is coupled to tether-attachment device 46 via a disconnectable tether fastener 44, discussed below. Tether 38 passes upward within frame 30 proximate upright member 26. Tether 38 then passes through a tether-guidance device 48, discussed below. Tether 38 then passes across frame 30 proximate transverse member 28. Tether 38 then passes through a tether-suspension device 50, discussed below. Tether 38 finally passes downward in the approximate center of frame 30 to singly-tethered ball 22. Tether 38 is coupled to singly-tethered ball 22 by a fixed tether fastener 36, discussed below, affixed to tether-attachment ring 40 at surface 42 of singly-tethered ball 22.

In the first preferred embodiment, tether-attachment device 46 has a short steel or aluminum tube of square cross section sized to fit and easily slide over upright member 26. A loop formed onto a side of the tube provides a place where tether 38 may be attached. Tether-attachment device 46 is affixed to upright member 26 at a desired tether-attachment-device location 52 by means of a locking screw 54. Tether-attachment device 46 is configured to be affixable to upright member 26 at any number of tether-attachment-device locations 52. In this manner, singly-tethered ball 22 may be positioned at any desired height above the plane (not shown) passing through base members 24.

Those skilled in the art will appreciate that, without departing from the spirit or scope of the present invention, any of a plurality of materials and shapes may be used for tether-attachment device 46. Similarly, tether-attachment device 46 may utilize any of a plurality of adjustment and/or locking methods. In this manner, an adjustable tether-attachment device 46 may be affixed to upright member 26 at any given tether-attachment-device location 52. Also, a plurality of fixed tether-attachment devices 46 affixed to upright member 26 may be used to allow selection of a desired tether-attachment-device location 52.

In the first preferred embodiment, tether-guidance device 48 is a hook or loop affixed within frame 30 to transverse member 28 proximate upright member 26. Similarly, tether-suspension device 50 is a hook or loop affixed within frame 30 to transverse member 28 proximate a midpoint 56 thereof. Tether 38 extends from tether-attachment device 46 to singly-tethered ball 22, freely passing over or through tether-guidance device 48 and tether-suspension device 50 en route. In this manner, the path of tether 38 is routed proximate frame 30 leaving singly-tethered ball 22 freely suspended midway between upright members 26. This allows an athlete to utilize ball 22 for exercise without interference from tether 38.

Alternatively, as depicted in FIG. 5, tether attachment device 46 is tether-suspension device 50. Tether 38 extends from tether-suspension device 50 to singly-tethered ball 22. As above, this allows an athlete to utilize ball 22 for exercise without interference from tether 38.

Those skilled in the art will appreciate that a plurality of specific device types and shapes may be used for tether-guidance device 48 and tether-suspension device 50 without departing from the spirit or scope of the present invention.

Tether 38 is an elasticized cord, similar to a bungee cord without its endhooks. By utilizing an elasticized cord, tether 38 cause the action of singly-tethered ball 22 to be "live." That is, ball 22 actively returns to its normal rest position. This increase the dynamics of system 20 and improves the exercise received by an athlete. Any of a plurality of materials, from cotton or hemp to rubber or latex, may be used for tether 38 to establish specific dynamics for system 20. The use of any of these materials does not effect a departure from the spirit or scope of the present invention.

Tether 38 is affixed to tether-attachment ring 40 of singly-tethered ball 22 by fixed tether fastener 36. Fixed tether fastener 36, as depicted, is a clamp securing the end of tether 38 into a loop 58. Loop 58 is passed through tether-attachment ring 40, then tether 38 is passed through loop 58 and snugged against tether-attachment ring 40. As known to those skilled in the art, this is but one of a plurality of methods of effecting fixed tether fastener 36. The utilization of other methods does not depart from the spirit or scope of the present invention.

Tether-attachment ring 40 is at surface 42 of singly-tethered ball 22. As depicted in FIG. 3, tether-attachment ring 40 may be realized as a protruding ring 60 which protrudes above surface 42. In this form, tether 38 is more easily attached to singly-tethered ball 22, but a danger exists of protruding ring 60 being inadvertently struck during exercise.

Alternatively, as depicted in FIG. 4, tether-attachment ring 40 may be realized as a recessed ring 62 which is recessed into surface 42. In this form, tether 38 is less easily attached to singly-tethered ball 22, but the danger of recessed ring 62 being inadvertently struck during exercise is significantly reduced.

As depicted in FIG. 3, disconnectable tether fastener 44 may be realized as an open hook 64 which is hooked into tether-attachment device 46. Open hook 64 is configured to detach from tether-attachment device 46 if excessive slack is produced in tether 38. The intent of this arrangement is to allow auto-detachment of tether 38 and subsequent dropping of singly-tethered ball 22 if singly-tethered ball 22 becomes "wild," i.e., sustains excessive gyrations. When wild, singly-tethered ball 22 may effect injury to the athlete performing the exercises. This auto-detachment safety feature is especially important if those exercises are head butts or other head exercises, and the danger of head injury is present.

Alternatively, as depicted in FIG. 4, disconnectable tether fastener 44 is realized as a closed hook 66 which is hooked into tether-attachment device 46. Closed hook 66 is configured to remain attached to tether-attachment device 46 regardless of the gyrations of singly-tethered ball 22. Closed hook 66 provides a more secure attachment of tether 38 to tether-attachment device 46 than does open hook 64.

Protruding ring 60 and recessed ring 62 are but two of a plurality of embodiments of tether-attachment ring 40 well known to those skilled in the art. Similarly, open hook 64 and closed hook 66 are but two of a plurality of well known embodiments of disconnectable tether fastener 44. Likewise, those skilled in the art will appreciate that, regardless of the pairings shown in FIGS. 3 and 4, the use of a particular embodiment of tether-attachment ring 40 is independent of the use of a particular embodiment of disconnectable tether fastener 44.

Figure 6:
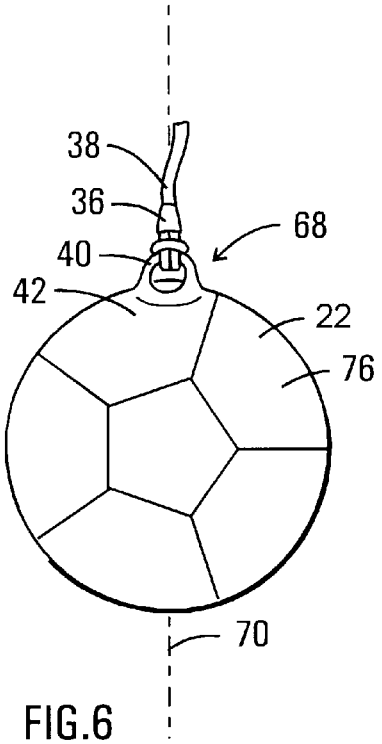
FIG. 6 depicts a tether-attachment ring at a tether-attachment location at an intersection of a surface and a diameter line of a singly-tethered ball realized as a spheroid in accordance with a preferred embodiment of the present invention.
Figure 7:
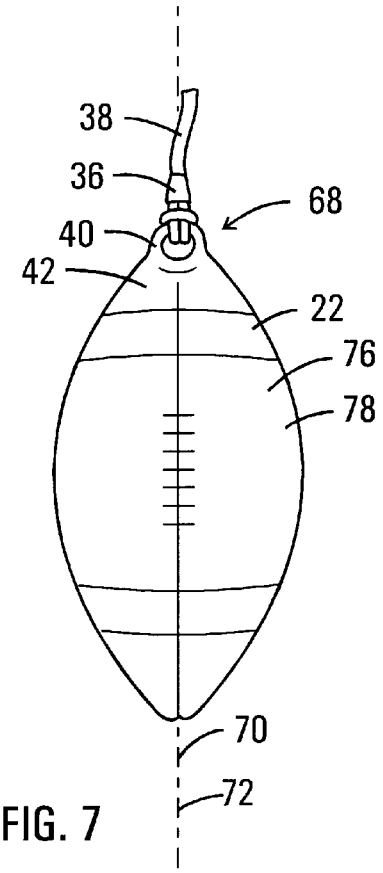
FIG. 7 depicts a tether-attachment ring at a tether-attachment location at an intersection of a surface and a longest-diameter line of a singly-tethered ball realized as a prolate spheroid in accordance with a preferred embodiment of the present invention.
Figure 8:
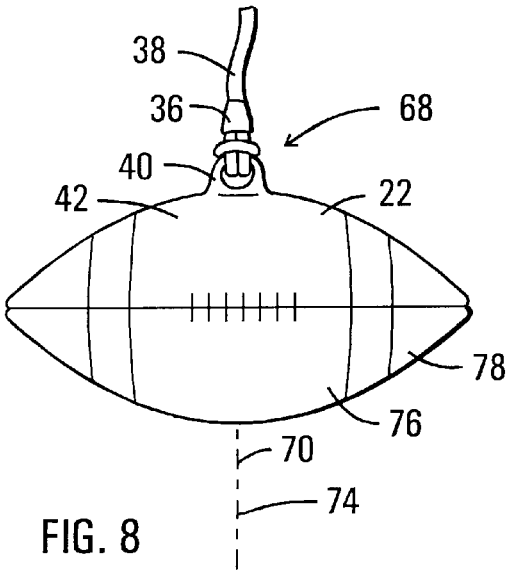
FIG. 8 depicts a tether-attachment ring at a tether-attachment location at an intersection of a surface and a shortest-diameter line of a singly-tethered ball realized as a prolate spheroid in accordance with a preferred embodiment of the present invention.

In accordance with preferred embodiments of the present invention, FIG. 6 depicts tether-attachment ring 40 at a tether-attachment location 68 at an intersection of surface 42 and a diameter line 70 of singly-tethered ball 22 realized as a spheroid 76, FIG. 7 depicts the same at an intersection of surface 42 and a longest-diameter line 72 of singly-tethered ball 22 realized as a prolate spheroid 78, and FIG. 8 depicts the same at an intersection of surface 42 and a shortest-diameter line 74 of singly-tethered ball 22 realized as prolate spheroid 78. The following discussion refers to FIGS. 6 through 8.

Tether-attachment ring 40 is positioned at tether-attachment location 68 at surface 42 of singly-tethered ball 22. Tether-attachment location 68 is where diameter line 70, i.e., a line coincident with a specific diameter of singly-tethered ball 22, intersects surface 42.

Singly-tethered ball 22 may be realized as spheroid 76, e.g., a soccer ball, or as prolate spheroid 78, e.g., a football.

For spheroid 76, diameter line 70 may be coincident with any diameter of spheroid 76 (FIG. 6). For prolate spheroid 78, diameter line 70 may be longest-diameter line 72 or shortest diameter line 74. Longest diameter line 72 is coincident with a longest diameter of prolate spheroid 78 (FIG. 7). Shortest-diameter line 74 is coincident with a shortest diameter of prolate spheroid 78 (FIG. 8).

Figure 9:
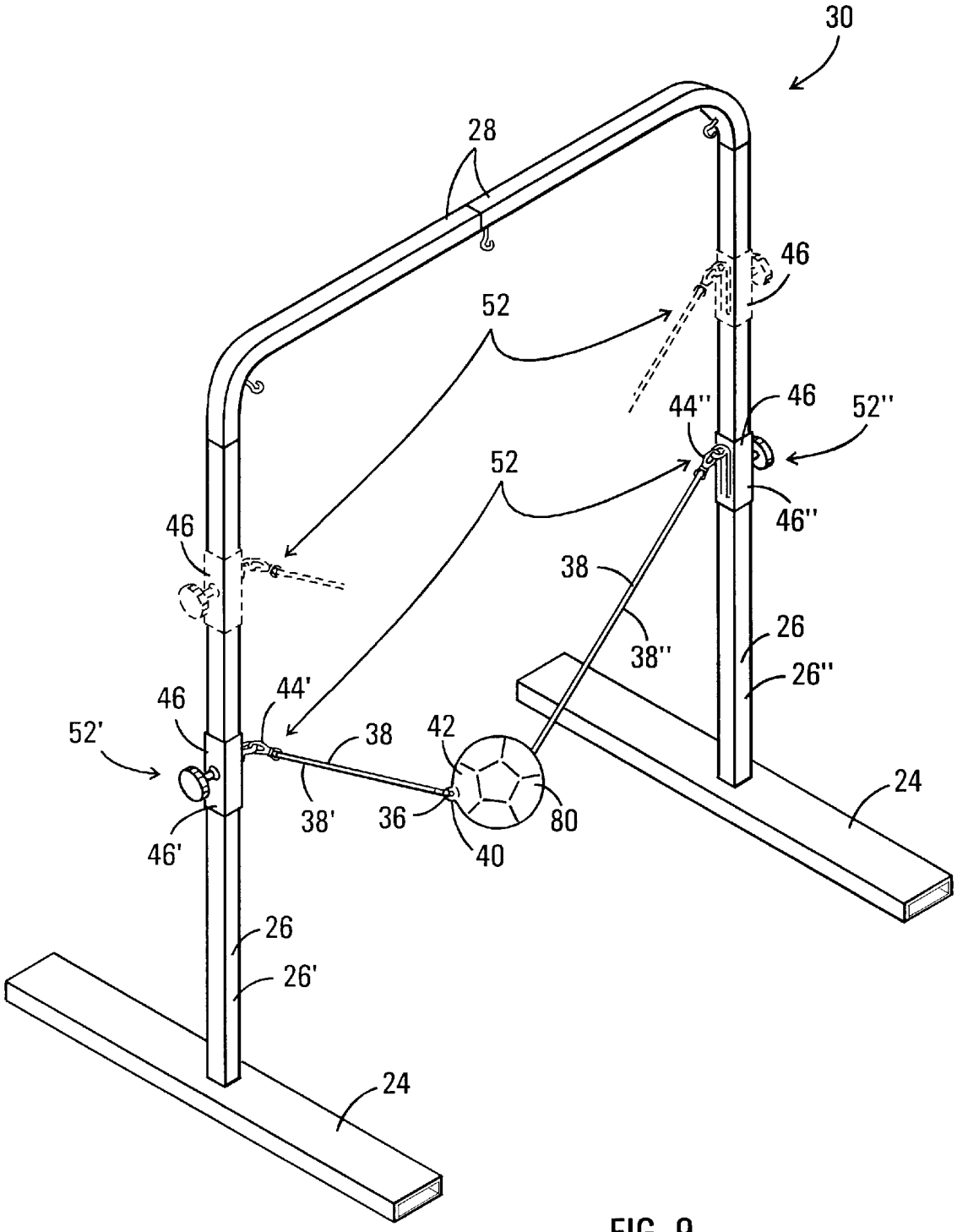
FIG. 9 depicts a sport training and exercise system configured for use with a doubly-tethered ball in accordance with a preferred embodiment of the present invention.
Figure 10:
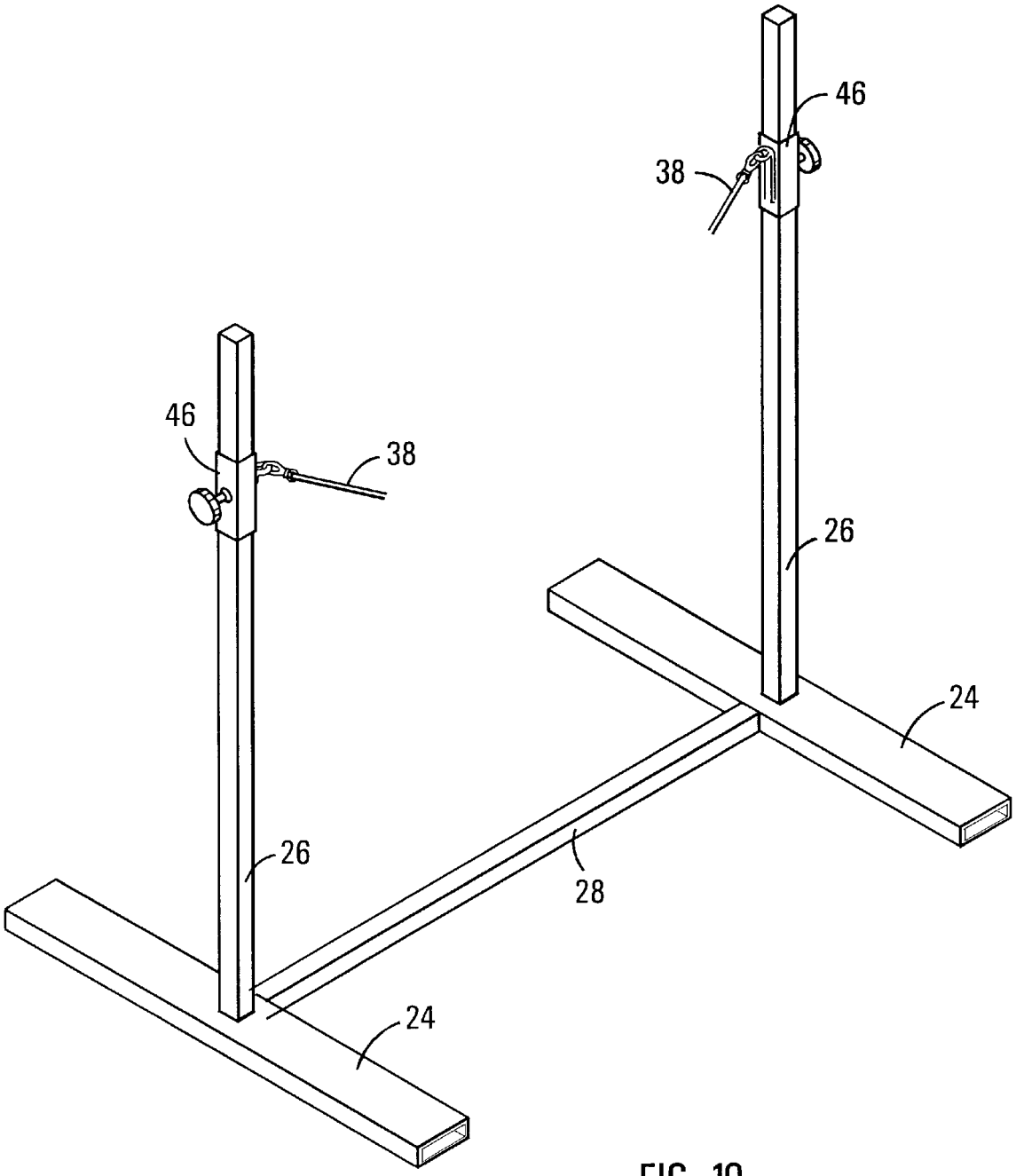
FIG. 10 depicts an alternative embodiment of a sport training and exercise system depicted in FIG. 9 having a transverse member affixed to base members in accordance with a preferred embodiment of the present invention.

In accordance with preferred embodiments of the present invention, FIG. 9 depicts sport training and exercise system 20 configured for use with a doubly-tethered ball 80, and FIG. 10 depicts an alternative embodiment of the same having transverse member 28 affixed to base members 24. The following discussion refers to FIGS. 1, 9, and 10.

A second preferred embodiment of sport training and exercise system 20, as depicted in FIG. 9, differs from the first preferred embodiment depicted in FIG. 1 and discussed above in that the second preferred embodiment of sport training and exercise system 20 has doubly-tethered ball 80 tethered to a pair of tether-attachment devices 46 by a pair of tethers 38. Like the first preferred embodiment, the second preferred embodiment includes base members 24, upright members 26, and transverse member 28. Upright members 26 and transverse member 28 make up frame 30.

In the second preferred embodiment, frame 30 encompasses doubly-tethered ball 80. A first tether-attachment device 46' is coupled to a first upright member 26' at a first tether-attachment-device location 52'. A first tether 38' is coupled to first tether-attachment device 46' via first disconnectable tether fastener 44'. First tether 38' then passes within frame 30 through the plane (not shown) passing through frame 30 to doubly-tethered ball 80. First tether 38' is coupled to doubly-tethered ball 80 by a first fixed tether fastener 36' affixed to a first tether-attachment ring 40' at a first tether-attachment location 68' at surface 42 of doubly-tethered ball 80.

Similarly, a second tether-attachment device 46" is coupled to a second upright member 26" at a second tether-attachment device location 52". A second tether 38" is coupled to second tether-attachment device 46" via second disconnectable tether fastener 44". Second tether 38" then passes within frame 30 through the plane (not shown) passing through frame 30 to doubly-tethered ball 80. Second tether 38" is coupled to doubly-tethered ball 80 by a second fixed tether fastener 36" affixed to a second tether-attachment ring 40" at a second tether-attachment location 68" at surface 42 of doubly-tethered ball 80.

By utilizing two tethers 38' and 38", doubly tethered ball 80 will have a reactions confine to an area within or proximate a plane (not shown) nominally midway between first and second upright members 26' and 26" and substantially perpendicular to both the plane (not shown) passing through frame 30 and the plane (not shown) passing through base members 24.

As in the first preferred embodiment, tether-attachment rings 40 may be realized as protruding rings 60 (as in FIG. 3), as recessed rings 62 (as in FIG. 4), or as other embodiments of tether-attachment rings 40 well known to those skilled in the art.

In the second preferred embodiment, disconnectable tether fasteners 44 are normally realized as closed hooks 66 (as in FIG. 4), since doubly-tethered ball 80 is normally more likely to have slack during rebound than is singly-tethered ball 22.

In a variation of the second preferred embodiment, as depicted in FIG. 10, transverse member 28 may be affixed to base members 24 proximate the bottoms of upright members 26. This configuration allows tether-attachment devices 46 to be positioned so as to allow doubly-tethered ball 80 (not shown in FIG. 10) to be used in a manner that would cause tethers 38 to wrap around a top-positioned transverse member 28 (FIG. 9).

Those skilled in the art will appreciate that transverse member 28 effectively determines the distance between upright members 26, and that transverse member 28 may be top-mounted, as in FIG. 9, bottom-mounted, as in FIG. 10, or otherwise coupled between upright members 26 without departing from the spirit or the scope of the present invention.

Figure 11:
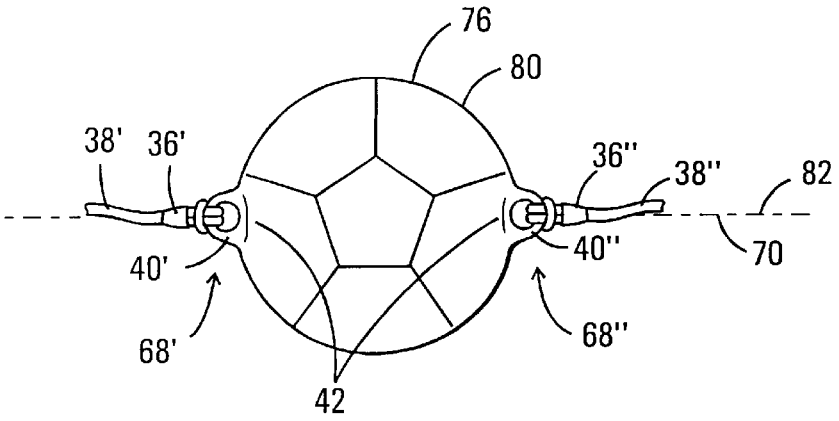
FIG. 11 depicts a pair of tether-attachment rings at a pair of tether-attachment locations at intersections of a surface of a doubly-tethered ball realized as a spheroid and a chord line passing therethrough in accordance with a preferred embodiment of the present invention.
Figure 12:
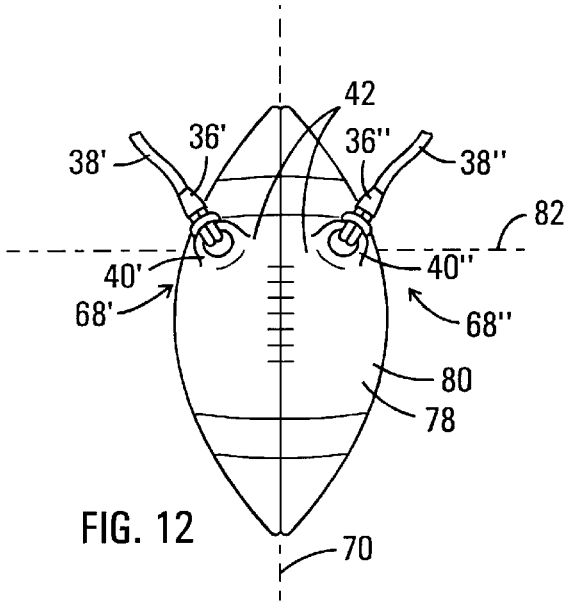
FIG. 12 depicts a pair of tether-attachment rings at a pair of tether-attachment locations at intersections of a surface of a doubly-tethered ball realized as a prolate spheroid and a chord line passing therethrough in accordance with a preferred embodiment of the present invention.
Figure 13:
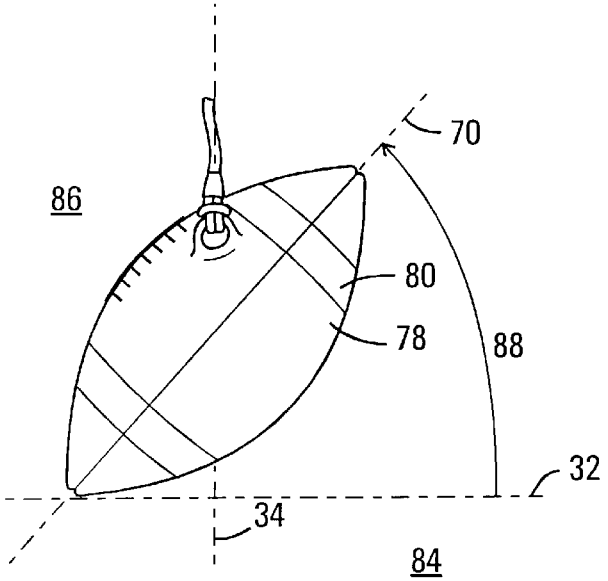
FIG. 13 depicts the suspension attitude of the prolate spheroid depicted in FIG. 12 in a plane substantially perpendicular to both a plane through a pair of base members and a plane through a pair of upright members in accordance with a preferred embodiment of the present invention.

In accordance with preferred embodiments of the present invention, FIG. 11 depicts a pair of tether-attachment rings 40 at a pair of tether-attachment locations 68 at intersections of surface 42 of doubly-tethered ball 80 realized as spheroid 76 and a chord line 82 passing therethrough, FIG. 12 depicts the same at intersections of surface 42 of doubly-tethered ball 80 realized as prolate spheroid 78 and a chord line 82 passing therethrough, and FIG. 13 depicts a suspension attitude 84 of prolate spheroid 78 depicted in FIG. 12 in a ball plane 86 substantially perpendicular to both base plane 32 and frame plane 34. The following discussion refers to FIGS. 9 and 11 through 13.

Tether-attachment rings 40 are positioned at tether-attachment locations 68 at surface 42 of doubly-tethered ball 80. Tether-attachment locations 68 are where chord line 82, i.e., a line coincident with a chord through doubly-tethered ball 80, intersects surface 42.

In FIG. 11, doubly-tethered ball 80 is realized as spheroid 76, e.g., a soccer ball. Chord line 82, as shown, is coincident with a diameter of spheroid 76, causing doubly-tethered ball 80 to be symmetrically tethered and suspended. Those skilled in the art will appreciate that chord line 82 would not be coincident with a diameter of doubly-tethered ball 80 if it is desired that doubly-tethered ball 80 be asymmetrically suspended.

In FIGS. 12 and 13, doubly-tethered ball 80 is realized as prolate spheroid 78, e.g., a football. Chord line 82, as shown, is located above and in front of a center of doubly-tethered ball 80 perpendicular to longest-diameter line 72 of prolate spheroid 78. Positioning chord line 82 in this manner places tether-attachment locations 68 in the upper-front quadrant of doubly-tethered ball 80, where chord line 82 intersects surface 42. This in turn causes prolate spheroid 78 to posses suspension attitude 84. When in attitude 84, longest-diameter line 72 resides in ball plane 86 at an oblique angle 88 relative to base plane 32. Ball plane 86 is the plane approximately midway between upright members 26' and 26" and substantially perpendicular to both base plane 32, the plane passing through base members 24, and frame plane 34, the plane passing through frame 30. In normal use, prolate spheroid 78 would be kicked in ball plane 86 on a side where oblique angle 88 is acute.

Figure 14:
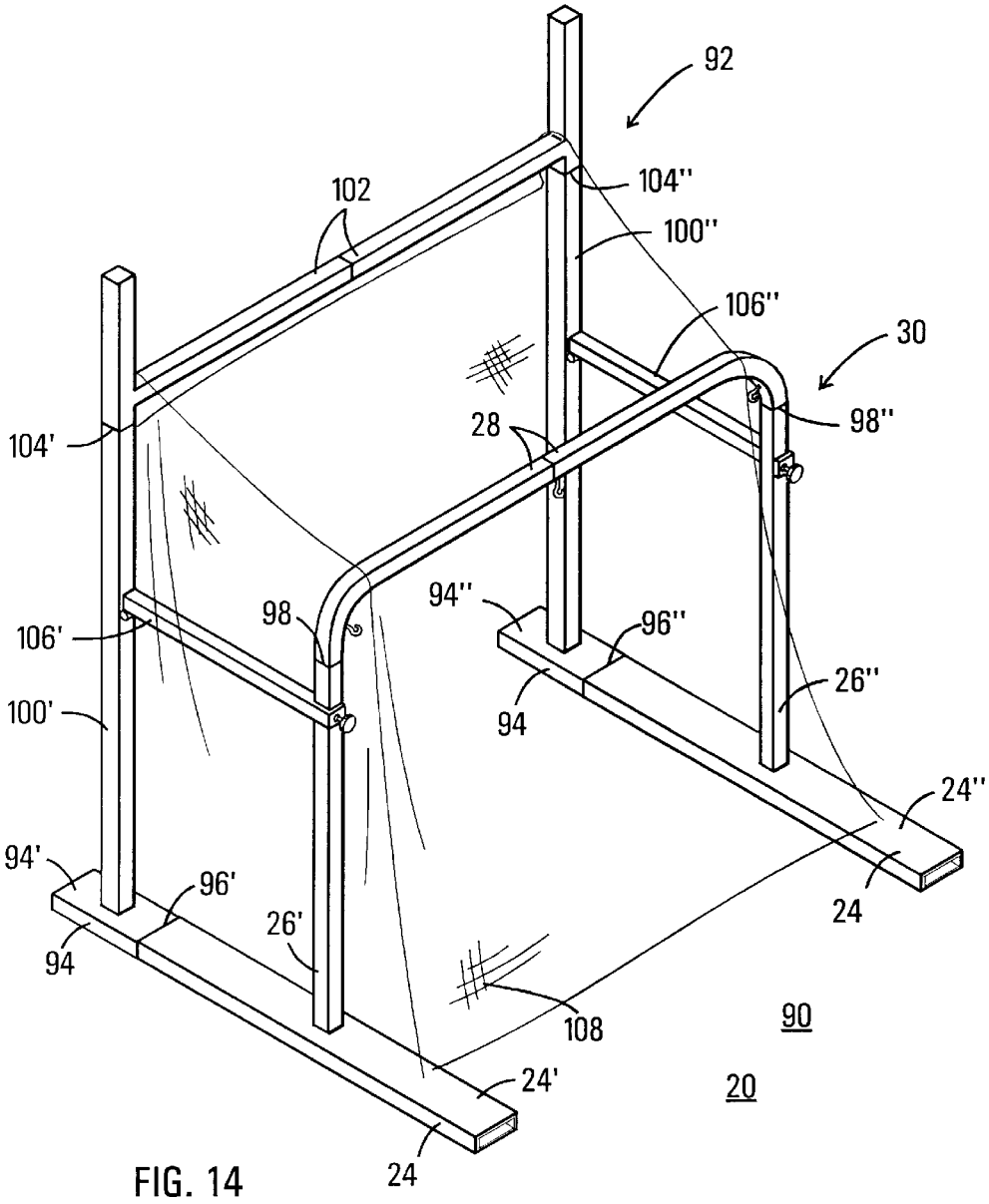
FIG. 14 depicts a sport training and exercise system configured for use as a soccer goal in accordance with a preferred embodiment of the present invention.

In accordance with preferred embodiments of the present invention, FIG. 14 depicts sport training and exercise system 20 configured for use as a soccer goal 90 in accordance with a preferred embodiment of the present invention. The following discussion refers to FIG. 14.

In a third preferred embodiment of sport training and exercise system 20, as depicted in FIG. 14, system 20 is configured as soccer goal 90. In this configuration, system 20 is made up of a first frame 30 coupled to first base members 24 and a second frame 92 coupled to second base members 94.

First base members 24 are directly coupled to second base members 94. That is, a left first-base member 24' is coupled to a left second-base member 94' at a left base join 96', and a right first-base member 24" is coupled to a right second-base member 94" at a right base join 96". In this manner, a composite base is provide to support first frame 30 and second frame 92.

First frame 30 includes a plurality of members and the joins between them. Progressing from left first-base member 24' to right first-base member 24", first frame 30 incorporates a left first-upright member 26' coupled to left first-base member 24', a first transverse member 28 coupled to left first-upright member 26' at a left first-upright-transverse join 98', a right first-upright member 26" coupled to first transverse member 28 at a right first-upright-transverse join 98", and right first-upright member 26" coupled to right first-base member 24".

Similarly, second frame 92 also includes a plurality of members and the joins between them. Progressing from left second-base member 94' to right second-base member 94", second frame 92 incorporates a left second-upright member 100' coupled to left second-base member 94', a second transverse member 102 coupled to left second-upright member 100' at a left second-upright-transverse join 104', a right second-upright member 100" coupled to second transverse member 102 at a right second-upright-transverse join 104", and right second-upright member 100" coupled to right second-base member 94".

First frame 30 is coupled to second frame 92 for strength and rigidity. That is, a left side member 106' couples left first-upright member 26' to left second-upright member 100' and a right side member 106" couples right first-upright member 26' to right second-upright member 100".

A net 108 is coupled to first transverse member 28 and second transverse member 102. Net 108 is then draped over system 20 to finish the creation of soccer goal 90.

The above joins coupling pairs of members are described in detail later.

Those skilled in the art will appreciate that the dimensions of the above members are such that, once integrated, a regulation soccer goal 90 is formed. There are a plurality of methods of combining members of various dimensions to create soccer goal 90. The use of any of those other methods does not depart from the spirit and scope of the present invention.

Figure 15:
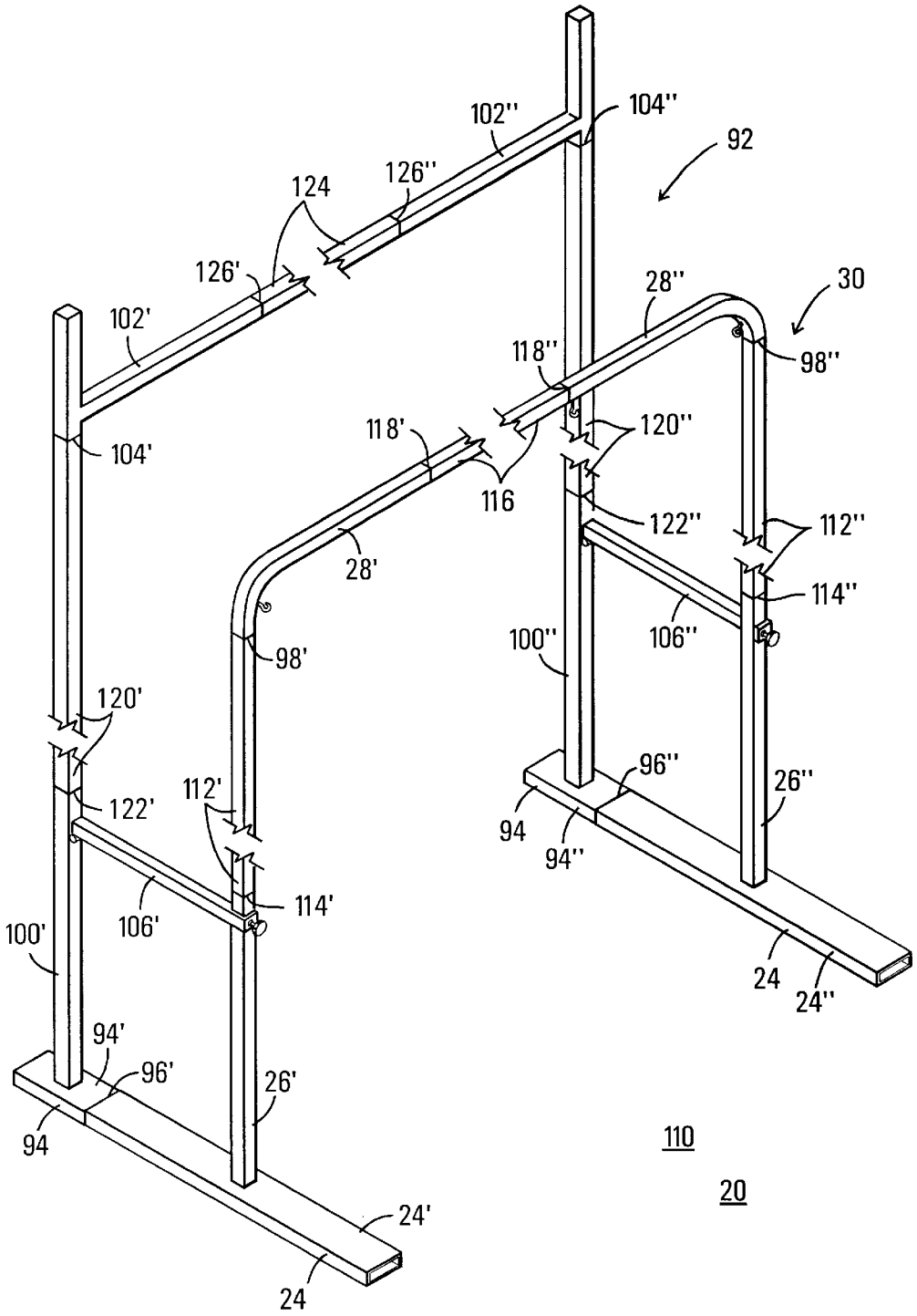
FIG. 15 depicts a sport training and exercise system configured for use as a football goal in accordance with a preferred embodiment of the present invention.

In accordance with preferred embodiments of the present invention, FIG. 15 depicts sport training and exercise system 20 configured for use as a football goal 110 in accordance with a preferred embodiment of the present invention. The following discussion refers to FIG. 15.

In a fourth preferred embodiment of sport training and exercises system 20, as depicted in FIG. 15, system 20 is configured as football goal 110. As for soccer goal 90 previously discussed, system 20 is made up of a first frame 30 coupled to first base members 24 and a second frame 92 coupled to second base members 94, though the number of members and joins in the frames differs from the soccer-goal frames.

As before, first base members 24 are directly coupled to second base members 94. That is, left first-base member 24' is coupled to left second-base member 94' at left base join 96', and right first-base member 24" is coupled to right second-base member 94" at right base join 96".

Progressing from left first-base member 24' to right first-base member 24", first frame 30 incorporates left first-upright member 26' coupled to left first-base member 24', a left first-upright-extension member 112' couple to left first-upright member 26' at a left first-upright-extension join 114', a left first-transverse member 28' coupled to left first-upright-extension member 112' at left first-upright-transverse join 98', a first transverse-extension member 116 coupled to left first-transverse member 28' at a left first transverse-extension join 118', a right first-transverse member 28' coupled to first transverse-extension member 116 at a right first-transverse-extension join 118', a right first-upright-extension member 112" coupled to right first-transverse member 28" at right first-upright-transverse join 98", right first-upright member 26" coupled to right first-upright extension member 112" at a right first-upright-extension join 114", and right first-upright member 26" coupled to right first-base member 24".

Similarly, progressing from left second-base member 94' to right second-base member 94", second frame 92 incorporates left second-upright member 100' coupled to left second-base member 94', a left second-upright-extension member 120' couple to left second-upright member 100' at a left second-upright-extension join 122', a left second-transverse member 102' coupled to left second-upright-extension member 120' at left second-upright-transverse join 104', a second transverse-extension member 124 coupled to left second-transverse member 102' at a left second transverse-extension join 126', a right second-transverse member 102" coupled to second transverse-extension member 124 at a right second-transverse-extension join 126", a right second-upright-extension member 120" coupled to right second-transverse member 102" at right second-upright-transverse join 104", right second-upright member 100" coupled to right second-upright extension member 120" at a right second-upright-extension join 122", and right second-upright member 100' coupled to right second-base member 94".

Again, first frame 30 is coupled to second frame 92 for strength and rigidity. That is, left side member 106' couples left first-upright member 26' to left second-upright member 100' and right side member 106" couples right first-upright member 26" to right second-upright member 100".

Those skilled in the art will appreciate that the dimensions of the above members are such that, once integrated, a regulation football goal 110 is formed. Extension members may individually be made up of two or more smaller extension members to increase transportability. There are a plurality of methods of combining members of various dimensions to create football goal 110. The use of any of those other methods does not depart from the spirit and scope of the present invention.

Figure 16:
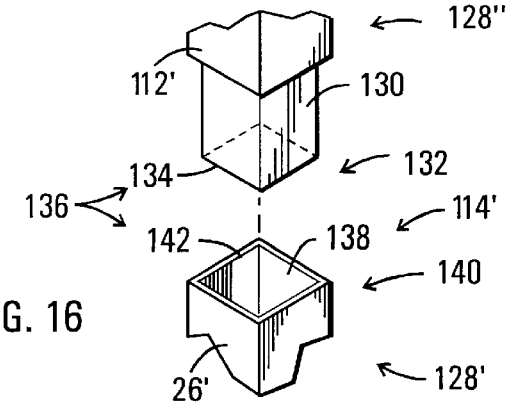
FIG. 16 depicts an exploded view of a join between two mating members in accordance with a preferred embodiment of the present invention.

In accordance with preferred embodiments of the present invention, FIG. 16 depicts an exploded view of a join between two mating members. The following discussion refers to FIGS. 1, 9, and 14 through 16.

In all four preferred embodiments described above, sport training and exercise system 20 includes either frame 30 or first frame 30 and second frame 92. Frames 30 and 92 are made up of various members and the joins between these members. Utilizing left first-upright member 26' as an exemplary first member, left first-upright-extension member 112' as an exemplary second member, and left first-upright-extension join 114' as an exemplary join (FIG. 15), FIG. 16 depicts a typical join. Those skilled in the art will appreciate that first exemplary member 26', second exemplary member 112', and exemplary join 114' may be any two mated members and the join therebetween.

Exemplary join 114' is a union of two exemplary members 26' and 110', One of exemplary members 26' and 112' has a first mating end 128', while the other of exemplary members 26' and 112' has a second mating end 128'.

First mating end 128' possesses a mating stub 130. Mating stub 130 has a cross section 132 with an outer periphery 134 of a predetermined shape 136. Second mating end 128" possesses a mating socket 138. Mating socket 138 has a cross section 140 with an inner periphery 142 of substantially predetermined shape 136. Mating stub 130 is thus configured to be inserted into and mate with mating socket 138. Mating stub 130 is retained in mating socket 138 by friction and/or pressure.

Those skilled in the art will appreciate that the above discussion is representative of one of a plurality of ways of effecting a join between two members. The use of another of those ways does not depart from the scope and spirit of the present invention.

It should be noted that sport training and exercise system 20 is intended for portable use with easy setup and tear down. As such, the materials and dimensions of the components should be selected for suitability therefor.

In summary, the present invention provides sport training and exercise system 20 for soccer and/or football. System 20 is portable, easily set up, easily taken down, and suitable for use by a solo athlete. System 20 utilizes a minimum of space and provides for a variety of different ball training and exercise functions, as well as serving as either a soccer or football goal. System 20 is cost-efficient, placing well within the reach of individuals and/or small groups.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A sport training and exercise system comprising:

a pair of base members;

a pair of upright members coupled to said base members;

a transverse member coupled to said upright members;

a tether-attachment device slidably coupled to a frame, said frame comprising said upright members and said transverse member;

a ball; and a tether tethering said ball to said tether-attachment device, wherein said tether-attachment device is affixable to said frame at a plurality of tether-attachment-device locations for positioning said ball at a desired height.

2. A sport training and exercise system as claimed in claim 1 wherein:

said tether-attachment device is coupled to said frame upon one of said upright members;

said system additionally comprises a tether-guidance device coupled to said transverse member proximate one of said upright members;

said system additionally comprises a tether-suspension device coupled to said transverse member proximate a midpoint thereof; and said tether passes through said tether-suspension device and said tether-guidance device while tethering said ball to said tether-attachment device.

3. A sport training and exercise system as claimed in claim 1 wherein:

said tether-attachment device is coupled to said frame upon said transverse member;

said tether attachment device comprises a tether suspension device; and said tether tethers said ball to said tether suspension device.

4. A sport training and exercise system as claimed in claim 1 wherein said ball is a spheroid, and wherein a tether-attachment ring is at a tether-attachment location at a surface of said spheroid where a diameter line thereof intersects said surface.

5. A sport training and exercise system as claimed in claim 4 wherein said spheroid is a prolate spheroid and said diameter line is a longest-diameter line thereof.

6. A sport training and exercise system as claimed in claim 4 wherein said spheroid is a prolate spheroid and said diameter line is a shortest-diameter line thereof.

7. A sport training and exercise system comprising:

a pair of base members;

a pair of upright members coupled to said base members;

a transverse member coupled to said upright members;

a tether-attachment device coupled to a frame, said frame comprising said upright members and said transverse member;

a ball; and a tether tethering said ball to said tether-attachment device, said tether including a fixed fastener fastening said tether to said ball and a disconnectable fastener fastening said tether to said tether-attachment device.

8. A sport training and exercise system as claimed in claim 7 wherein said disconnectable fastener is configured to disconnect from said tether-attachment device when a predetermined amount of slack is realized in said tether.

9. A sport training and exercise system comprising:

a pair of base members;

a pair of upright members coupled to said base members;

a transverse member coupled to said upright members, wherein said upright members are substantially parallel and are separated by a distance determined by said transverse member, and said transverse member is affixed to said base members proximate the bottoms of said upright members;

a pair of tether-attachment devices coupled to a frame, said frame comprising said upright members and said transverse member;

a ball; and a pair of tethers tethering said ball, at a pair of tether attachment locations at a surface of said ball, to said tether-attachment devices.

10. A sport training and exercise system as claimed in claim 9 wherein said ball comprises a pair of tether-attachment rings at said tether-attachment locations.

11. A sport training and exercise system as claimed in claim 10 wherein said ball is a spheroid, and wherein said tether-attachment locations are located where a chord of said spheroid intersects said surface.

12. A sport training and exercise system as claimed in claim 11 wherein said spheroid is a prolate spheroid, wherein said chord is perpendicular to a longest-diameter line of said prolate spheroid and positioned so as to maintain said prolate spheroid in an attitude such that said longest-diameter line forms an oblique angle relative to a base plane.

13. A sport training and exercise system as claimed in claim 12 wherein said oblique angle resides in a ball plane perpendicular to a frame plane passing through said pair of upright members.

14. A sport training and exercise system as claimed in claim 9 wherein said tether-attachment devices are affixable to said frame upon said upright members at a plurality of pairs of tether-attachment-device locations.

15. A sport training and exercise system as claimed in claim 14 wherein each of said pairs of tether-attachment-device locations comprises:

a first tether-attachment-device location upon a first one of said pair of upright members; and a second tether-device location upon a second one of said pair of upright members.

16. A sport training and exercise system as claimed in claim 9 wherein one of said tethers is an elasticized cord.

17. A sport training and exercise system as claimed in claim 9 wherein said base members c omprise lower portions of said upright members, said lower portions being embedded into the ground so as to maintain said upright members in a substantially vertical attitude.

* * * * *